US010876302B2

(12) United States Patent
Bevernage et al.

(10) Patent No.: US 10,876,302 B2
(45) Date of Patent: Dec. 29, 2020

(54) SET OF PANELS FOR FLOOR, WALL OR CEILING COVERING

(71) Applicant: BerryAlloc NV, Menen (BE)

(72) Inventors: Leo Marie Richard Bevernage, Avelgem (BE); Leif Kare Hindersland, Lyngdal (NO); Tor Inge Hausvik, Lyngdal (NO); Dag Arnes, Lyngdal (NO); Lasse Vetland, Vanse (NO)

(73) Assignee: BerryAlloc NV, Menen (BE)

( * ) Notice: Subject to any disclaimer, the term of this patent is extended or adjusted under 35 U.S.C. 154(b) by 0 days.

(21) Appl. No.: 16/579,735

(22) Filed: Sep. 23, 2019

(65) Prior Publication Data

US 2020/0157821 A1 May 21, 2020

Related U.S. Application Data

(63) Continuation of application No. 15/766,359, filed as application No. PCT/EP2016/073988 on Oct. 7, 2016, now Pat. No. 10,422,143.

(30) Foreign Application Priority Data

Oct. 8, 2015 (EP) ..... 15189039

(51) Int. Cl.
*E04F 15/02* (2006.01)

(52) U.S. Cl.
CPC .... *E04F 15/02038* (2013.01); *E04F 2201/03* (2013.01); *E04F 2201/0535* (2013.01); *E04F 2201/0576* (2013.01); *E04F 2201/0588* (2013.01)

(58) Field of Classification Search
CPC .. E04F 15/02308; E04F 2201/03; E04F 15/02
See application file for complete search history.

(56) References Cited

U.S. PATENT DOCUMENTS

| | | | | |
|---|---|---|---|---|
| 9,366,036 | B2 * | 6/2016 | Pervan | E04B 5/02 |
| 9,376,822 | B2 | 6/2016 | Hannig | |
| 9,464,444 | B2 * | 10/2016 | Engstrom | E04F 15/02038 |
| 9,725,912 | B2 * | 8/2017 | Pervan | E04F 15/02038 |

(Continued)

FOREIGN PATENT DOCUMENTS

| | | |
|---|---|---|
| EP | 2 687 650 | 1/2014 |
| WO | WO 2012/007851 | 1/2012 |

*Primary Examiner* — Paola Agudelo
(74) *Attorney, Agent, or Firm* — Levy & Grandinetti

(57) ABSTRACT

A set of panels for covering floors, ceilings or walls is disclosed. Specifically, sets of panels including a plurality of panels joined with a mechanical locking at their adjacent edges. Each of the panels includes at least two pairs of parallel side edges. When the panels are installed in rows, the adjacent edges of two adjacent panels in one row are locked to one another and the adjacent panels of the adjacent rows are locked to one another. Locking provides connecting while preventing movement spacing the locked panels apart in a direction perpendicular to the coupled side edges by a translation in the plane of the bottom surface of the panels, and preventing movement spacing the locked panels apart in a direction perpendicular to the coupled side edges by a translation in a plane perpendicular to the bottom surface of the panels.

14 Claims, 5 Drawing Sheets

(56) References Cited

U.S. PATENT DOCUMENTS

| | | | | |
|---|---|---|---|---|
| 2007/0006543 | A1* | 1/2007 | Engstrom | E04F 15/02 52/582.1 |
| 2010/0300029 | A1* | 12/2010 | Braun | E04F 15/02 52/588.1 |
| 2011/0271632 | A1 | 11/2011 | Cappelle et al. | |
| 2014/0033636 | A1* | 2/2014 | Cappelle | E04F 15/02033 52/592.1 |
| 2014/0130437 | A1* | 5/2014 | Cappelle | E04F 15/02 52/582.2 |
| 2015/0176289 | A1* | 6/2015 | Hannig | E04F 13/0894 52/582.2 |
| 2015/0300029 | A1* | 10/2015 | Pervan | E04B 5/02 52/582.2 |
| 2016/0069087 | A1* | 3/2016 | Engstrom | E04C 2/38 52/309.1 |
| 2016/0288447 | A1* | 10/2016 | Cordeiro | B32B 3/06 |
| 2017/0016235 | A1* | 1/2017 | Hannig | E04F 15/02038 |
| 2017/0165936 | A1* | 6/2017 | Schulte | F01M 1/10 |
| 2018/0179763 | A1* | 6/2018 | Simon | E04F 15/02038 |
| 2018/0274246 | A1* | 9/2018 | Vandevoorde | E04F 15/107 |
| 2018/0298618 | A1* | 10/2018 | Bevernage | E04F 15/02038 |

* cited by examiner

SET OF PANELS FOR FLOOR, WALL OR CEILING COVERING

FIELD OF THE INVENTION

The invention generally relates to the field of sets of panels for covering floors, ceilings or walls, in particular sets of panels comprising a plurality of panels to be joined at their adjacent edges.

BACKGROUND OF THE INVENTION

The disclosure aims at a set of panels for covering floors, ceilings or walls with a mechanical locking between adjacent panels.

Sets of panels for flooring purposes are well known and widely spread in both private homes, business offices and industrial spaces. In general the panels have a rectangular form and are arranged in rows, whereby the adjacent edges (both longitudinal and transversal) of the adjacent panels are coupled to obtain a plain floor (so-called floating flooring systems). In order to improve the coupling between two adjacent panels, it is known to dispose retaining profiles along the edges of the panels, which retaining profiles are configured such as to match in one another and prevent unintentional separation of the panels during use or assembly.

Numerous systems for coupling adjacent panels known, either with integrated or with separate locking profiles between both panels to allow easy assembly, to provide a locking between the panels, preventing the panels from been moved apart once assembled.

EP 2687650 discloses a set of panels wherein each panel comprises a pair of retaining profiles that can cooperate to join the adjacent edges of two adjacent panels, whereby a separate locking profile is mounted on one of the retaining profiles to obtain both a vertical and horizontal locking.

Despite the numerous existing solutions for joining adjacent panels of a flooring system, there remains a market need for improving speed of assembly of the panels and for improving the durability of the panels, in particular at the edges during assembly of the flooring system and during the entire lifetime of the flooring system.

SUMMARY OF THE INVENTION

In order to address one or more of the above identified market needs the present invention concerns set of panels comprising:

a first panel (1) having a side edge (2) on which a first retaining profile (3) is disposed;

a second panel (4) having a side edge (5) on which a second retaining profile (6) is disposed that can be joined to the first retaining profile (3);

the first retaining profile (3) comprising a first protruding member (8) having a height ($H_B$-$H_{PM1}$) that is smaller than the height ($H_B$) of the first panel (1); and a first toothed part (9) disposed at a free end of the first protruding member (8) and having a height ($H_B$-$H_{T1}$) that is larger than ($H_B$-$H_{PM1}$) and smaller than ($H_B$) such as to define a first channel (10) between the first toothed part (9), a top surface (11) of the first protruding member (8) extending between the side edge (2) and first toothed part (9) and the side edge (2) of the first panel;

the first retaining profile (3) comprising a protruding rim (23) that extends from the side edge (2) along the length of that side edge (2) from a level $H_{TOP}$ to a level between $H_{TOP}$ and $H_{PL1}$, this protruding rim (23) as such partially extending above the first channel (10);

the second retaining profile (6) comprising a second protruding member (13) having a height ($H_{PM2}$) that is smaller than the height ($H_B$) of the second panel (4), and a second toothed part (14) disposed at a free end of the second protruding member (13), said second toothed part (14) configured to cooperate with the first channel (10), said second toothed part (14) comprising a groove (21) in a surface of the second toothed part (14) facing away from the side edge (5) of the second panel (4);

a locking profile (15) mounted to the first retaining profile (3), said locking profile (15) comprising:

a base (16) positioned in the first channel (10);

a first abutment portion (17) extending from a first edge of the base (16) and disposed along the edge of the channel (10) defined by the toothed part (9), said first abutment portion (17) defining an abutment surface (18) facing the first channel (10);

a second abutment portion (19) extending from a second edge of the base (16) opposite the first edge and positioned in the channel (10) along the side edge of the first panel (1), said second abutment portion (19) comprising a rim (22) at its free end and extending in a direction facing away from the side edge (2) of the first panel (1), such that the rim (22) of the locking profile is snapped into the groove (21) of the second retaining profile (6) upon joining two panels, characterized in that the locking profile (15) is at least partially attached to the first toothed part (9).

The present invention also concerns the use of a locking profile (15) for locking two adjacent panels of a set of panels comprising:

a first panel (1) having a side edge (2) on which a first retaining profile (3) is disposed;

a second panel (4) having a side edge (5) on which a second retaining profile (6) is disposed that can be joined to the first retaining profile (3);

the first retaining profile (3) comprising a first protruding member (8) having a height ($H_B$-$H_{PM1}$) that is smaller than the height ($H_B$) of the first panel (1); and a first toothed part (9) disposed at a free end of the first protruding member (8) and having a height ($H_B$-$H_{T1}$) that is larger than ($H_B$-$H_{PM1}$) and smaller than ($H_B$) such as to define a first channel (10) between the first toothed part (9), a top surface (11) of the first protruding member (8) extending between the side edge (2) and first toothed part (9) and the side edge (2) of the first panel;

the first retaining profile (3) comprising a protruding rim (23) that extends from the side edge (2) along the length of that side edge (2) from a level $H_{TOP}$ to a level $H_B$ between $H_{TOP}$ and $H_{PM1}$, this protruding rim (23) as such partially extending above the first channel (10);

the second retaining profile (6) comprising a second protruding member (13) having a height ($H_{PM2}$) that is smaller than the height ($H_B$) of the second panel (4)), and a second toothed part (14) disposed at a free end of the second protruding member (13), said second toothed part (14) configured to cooperate with the first channel (10), said second toothed part comprising a groove (21) in a surface of the second toothed part (14) facing away from the side edge (5) of the second panel; and said locking profile (15) configured to be mounted on the first retaining profile (3), and comprising:

a base (16) positioned in the first channel (10);

a first abutment portion (17) extending from a first edge of the base (16) and disposed along the edge of the channel (10) defined by the toothed part (9), said first abutment portion (17) defining an abutment surface (18) facing the first channel (10);

a second abutment portion (19) extending from a second edge of the base (16) opposite the first edge and positioned in the channel (10) along the side edge of the first panel, said second abutment portion (19) comprising a rim (22) at its free end and extending in a direction facing away from the side edge (2) of the first panel (1), such that the rim (22) of the locking profile is snapped into the groove (21) of the second retaining profile (6) upon joining two panels.

DETAILED DESCRIPTION

Figure 1:
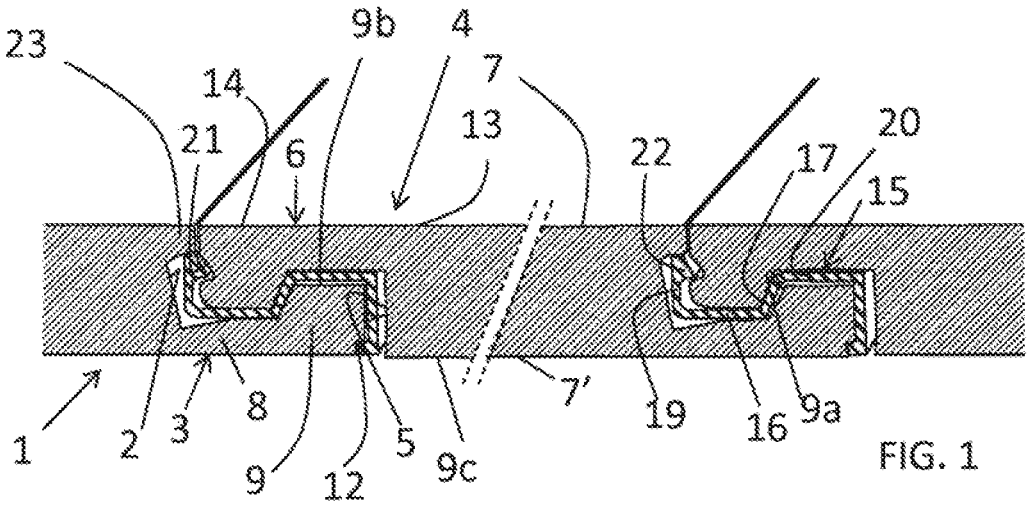
FIG. 1 schematically represents a cross section of a plurality adjacent panels according to the present invention.

As represented in FIG. 1, a set of panels according to the present invention comprises a plurality of panels each having a surface preferably with a decor visible when the panels are installed as a floor, wall or ceiling covering and further referred to herein as 'decor surface' (7), and an opposed surface (7', further referred to as 'bottom surface') directed to a floor, wall or ceiling covered by the panels when installed.

The panels roan have any suitable shape, including rectangular, square or polygonal. Each of the panels comprises at least two pairs of parallel side edges, and in the case of rectangular panels, one pair of long side edges extending in the length direction of the panels and another pair of short side edges or transversal edges extending in a width direction of the panels. The height $H_B$ of the panels is defined as the distance from the level $H_{TOP}$ (=0) of the decor surface (7) to the level $H_B$ (>0) of the bottom surface (7') (measured in a direction normal to the top surfaces).

When, and as represented in FIG. 1, rectangular panels are installed in rows, the adjacent short edges of two adjacent panels in one row are locked to one another and the adjacent long edges of panels of adjacent rows are locked to one another. Locking is hereby to be understood as connected while preventing movement spacing the locked panels apart in a direction perpendicular to the coupled side edges by a translation (not tilting) in the plane of the bottom surface of the panels (horizontal locking in the event of a horizontal surface such as a floor) and while preventing movement spacing the locked panels apart in a direction perpendicular to the coupled side edges by a translation (not tilting) in a plane perpendicular to the bottom surface of the panels (vertical locking in the event of a horizontal surface such as a floor).

Figure 2A:
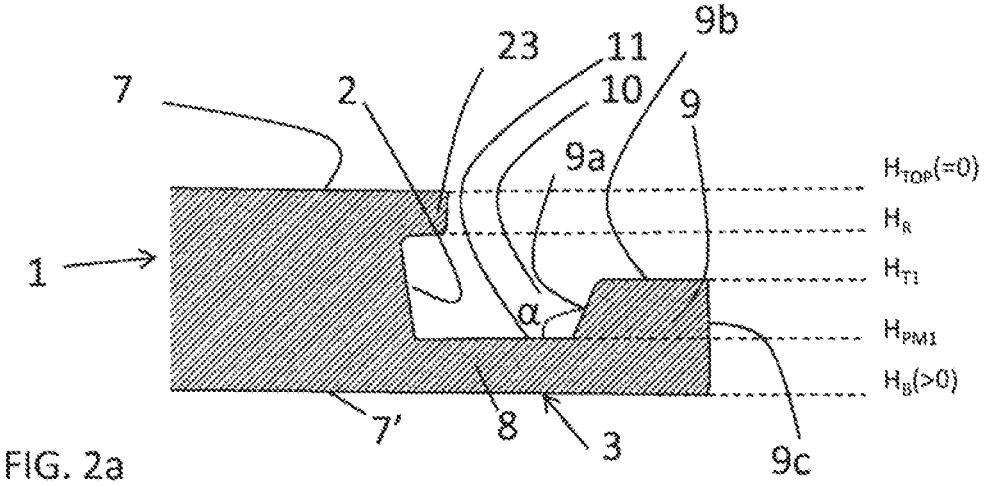
FIGS. 2*a* and 2*b* schematically represent a cross section of a part of the panels of the set of panels.
Figure 2B:
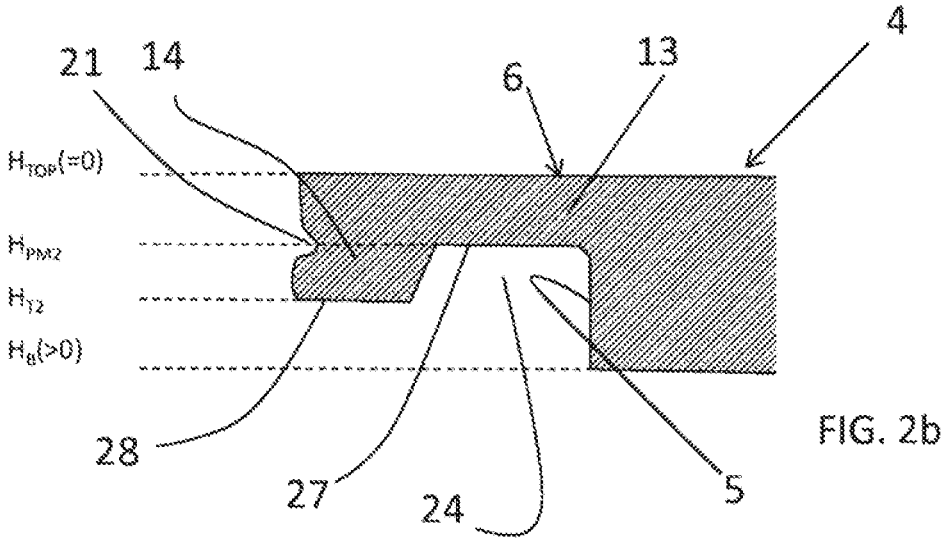

As illustrated in FIGS. 2*a* and 2*b*, to allow coupling adjacent panels, retaining profiles are disposed on at least one pair of parallel side edges of each panel (1, 4). As such a first retaining profile (3) is disposed on a first side edge (2) of each panel and a second retaining profile (6) is provided on a second side edge (5) of said each panel opposite to the first side edge (4), whereby the first and second side edges (4,5) extend parallel to one another and can be either short or long side edges of the panel.

The first retaining profile (3), shown in FIG. 2*a*, comprises a first protruding member (8) having a top surface (11), the first protruding member (8) preferably extending at least substantially, and more preferably entirely, along the first side edge (2) and a first toothed part (9) disposed at a free end of the first protruding member (8) and having an upper surface (9*b*), the first toothed part (9) preferably equally extending along the first side edge (2).

The first protruding member (8) extends in the height direction from the level $H_B$ of the bottom surface 7' to a level $H_{PM1}$ of the top surface (11) of the first protruding member (8). The first toothed part (9) extends in the height direction from the level $H_B$ of the bottom surface 7' to a level $H_{T1}$ of the upper surface (9*b*) of the first toothed part (9) between $H_{PM1}$ and $H_{TOP}$. As illustrated in FIG. 2*a*, the first retaining profile (3) defines a first channel (10) delimited by, on the one hand, the side edge (2) of the first panel and the toothed part (9) and on the other hand a top surface (11) of the first protruding member (8) extending between the side edge (2) and the first toothed part (9).

The first retaining profile (3) further comprises a protruding rim (23) that extends from the first side edge (2) along the length of that side edge from a level $H_{TOP}$ of the decor surface (7) to a level $H_R$ between $H_{TOP}$ and the top surface (11) of the first protruding member (8) at level $H_{PM1}$, this protruding rim (23) as such partially extending above the first channel (10). Preferably, the protruding rim (23) extends from the first side edge (2) along the length of that side edge from a level $H_{TOP}$ of the decor surface (7) to a level $H_R$ between $H_{TOP}$ and the upper surface (9*b*).

As represented in FIG. 1, a locking profile (15) is mounted to the first retaining profile (3), said locking profile (15) comprises: a base (16) that, in a mounted position, is seated in the first channel (10) along the top surface (11) of the first protruding member (8); a first abutment portion (17) extending along a surface (9*a*) of the first toothed part (9) defining an edge of the first channel (10); and a second abutment portion (19) located along the side edge (2) of the panel (1) delimiting the first channel (10), said second abutment portion (19) comprising a rim (22) at its free end and extending in a direction facing away from the side edge (2) of the first panel (1). The height of the second abutment portion is such that, in an assembled state of the panels, the free end of the second abutment portion (19) is situated against or substantially against a surface of the rim (23) facing the first channel (10). The first abutment portion (17) defines an abutment surface (18) facing away from the first toothed part (9), and hence facing the first channel (10). In one embodiment, the abutment surface (18) of the first abutment portion (17) facing away from the first toothed part (9) is roughened. This would further increase the resistance of locked panels against moving apart.

Figure 3A:
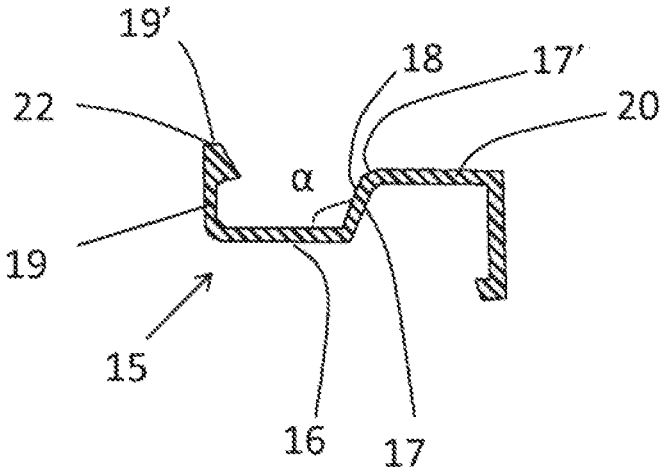
FIG. 3*a* schematically represents a cross section of a locking profile.
Figure 3B:
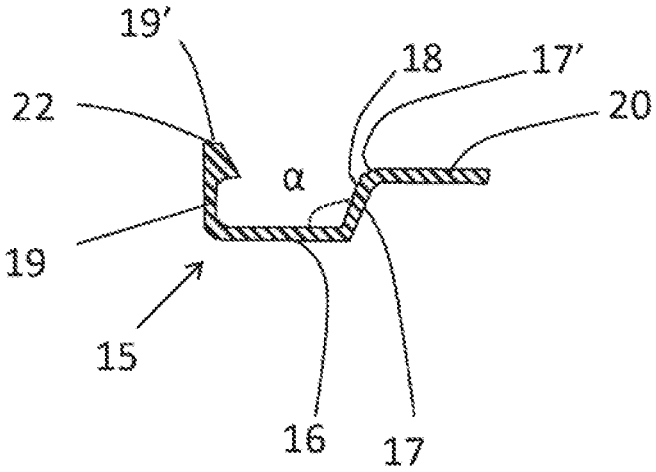
FIGS. 3*b* & 3*c* schematically represent alternative embodiments of the locking profile in FIG. 3*a;*
Figure 3C:
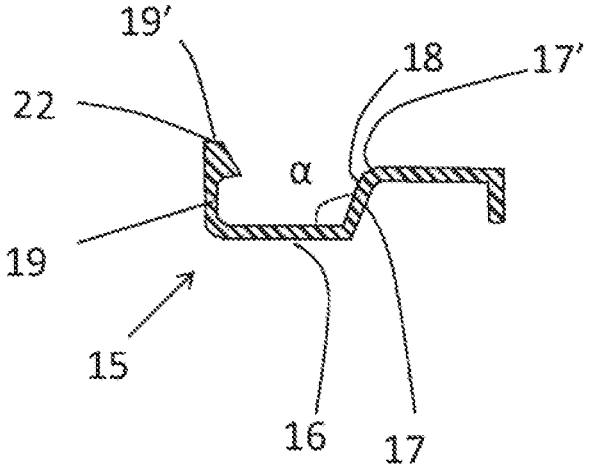

According to the invention, the locking profile (15) is attached to the first toothed part (9). As represented in FIGS. 1 and 3*a*, 3*b* & 3*c*, the locking profile (15) comprises a shielding portion (20) extending from the first abutment portion (17) along an upper surface (9*b*) of the first toothed part (9) up to the edge of said upper surface (9*b*) at the free end of the toothed part (9). Clearly, as shown in FIGS. 3*a* and 3*c* the shielding portion can further extend along the free end surface (9*c*) of the first toothed part (9). The attachment or fixation of the locking profile (15) to the first toothed part (9) can be achieved e.g., by an adhesive, applied between the locking profile (15) and one or more of: a portion of a top surface (11) of the protruding member (8), the surface (9*a*) of the first toothed part (9) defining an edge of the channel (10); the upper surface (9*b*) of the first toothed part (9) and a surface (9*c*) of the first toothed part defining a free end of that first toothed part (9). As such the locking profile (15) is fixed to the first toothed part (9) by at least its shielding portion (20), and preferably also by the first abutment portion (17), that is immobilized with respect to the first toothed part (9) and that shields the first toothed part (9) from an accidental impact, thereby decreasing the probability that the first retaining profile (3) is damaged during transport or assembly of the set of panels. Additionally, the shielding of the first toothed part (9) decreases the risk of damaging the first toothed part (9) upon disassembly of the panels and increases the overall strength of the panels in an assembled state.

The locking profile (15) extends along the first channel (10) and can have a length slightly smaller than the length of the concerned side edge (2) of the panel along which it extends or can have a length that is substantially shorter (e.g., 2-5 cm) than the side edge (2), in which case it is preferred that several spaced apart locking profiles (15) are provided along the side edge (2). The locking profile(s) (15) mounted to the first retaining profile (3) as such define a slot for receiving part of the second retaining profile (6) of an adjacent panel (4) of the set of panels therein.

In the represented embodiments, the first abutment portion (17), and in particular the abutment surface (18), is oriented such as to define an angle $\alpha$ with the decor surface (7) of the first panel that is larger than 90° and smaller than 135°, preferably smaller than 125° and most preferably smaller than 120°. In case of rectangular panels it is preferred that the angle $\alpha$ of the retaining profile along at least one edge (short edge) is chosen between 99° and 106°, whilst the angle $\alpha$ of the retaining profile along another edge (long edge) is preferably larger than 106° allowing more easy disassembly of the panels locked along that side edge by angling. Alternatively, the first abutment portion (17) may be partially curved.

The locking profile (15) is preferably manufactured in one piece and can be made in a metallic material such as aluminum or spring steel; or in a polymeric material, preferably a fibre reinforced polymeric material.

The second retaining profile (6) is disposed at the second side edge (5) of the panel opposed to the first side edge (2) where the first retaining profile (3) is disposed. According to the embodiment exemplified in FIGS. 1&2*b*, this second retaining profile (6) comprises a second protruding member (13) extending along the second side edge (5) and a second toothed part (14) disposed at a free end of the second protruding member (13) and equally extending along the second side edge (5).

The second protruding member (13) extends in the height direction from a level $H_{TOP}$ corresponding to the level at which the top surface (7) of the panel (2) extends to a level $H_{PM2}$ of the lower surface (27) of the second protruding member (13), between $H_{TOP}$ and $H_{T1}$. The second toothed part (14) extends in the height direction from the level $H_{TOP}$ to a level $H_{T2}$ of the lower surface (28) of the second toothed part (14), between $H_{PM1}$ and $H_{TOP}$. As illustrated in FIG. 2*b*, the second retaining profile (6) defines a second channel (24) delimited by, on the one hand, the side edge (5) of the second panel (4) and the second toothed part (14) and on the other hand a lower surface (27) of the second protruding member (13) extending between the second side edge (5) and the second toothed part (14). The second toothed part (14) further comprises a groove (21) in a surface of the second toothed part (14) facing away from the side edge (5) of the second panel (4).

In an assembled state, as illustrated in FIG. 1, the decor surfaces (7) of two adjacent panels extend in a same plane at a level $H_{TOP}$. The dimensions of the second toothed part (14) are such that—when two panels are locked—the second toothed part (14) of the second panel (4), on the one hand abuts the first abutment portion (17) of the locking profile (15) on the first panel (1) and, on the other hand abuts the protruding rim (23) of the first panel, thereby effectively preventing (however allowing some play within the standards well known to the Person skilled in the art) a translation of the second panel (4) in view of the first panel (1) in the plane of the bottom surfaces (7') of both panels (1, 4) and in a direction perpendicular to the cooperating side edges (2, 5) of both adjacent panels (1, 4) (horizontal locking). In case the surface (18) of the first abutment portion (17) facing the second toothed part (14) in an assembled state of the set of panels, is roughened, sliding of the second toothed part (14) in an upward direction along the first abutment portion (17) can be made more difficult, thereby increasing the strength of the horizontal locking. Further, the second toothed part (14) of the second panel is dimensioned such that, in the assembled state, it abuts the base (16) on the locking profile (15) of the first panel (1), while the rim (22) of that locking profile (15) snaps into the groove (21) of the second toothed part (14), whereby the locking profile (15) is prevented from moving out of the first channel (10) as the second abutment portion (19) abuts the rim (23) of the first panel (1). As a result both panels (1, 4) are locked from moving in a direction perpendicular to the decor surface (7) (vertical lock).

Figure 4:
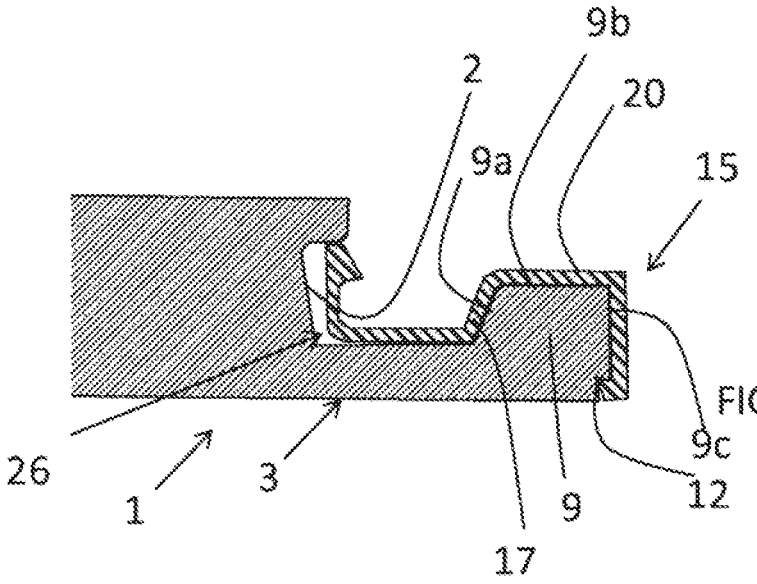
FIG. 4 schematically represents the locking profile of FIG. 3*a* mounted on a panel the set of panels.

FIGS. 3*a* & 4 illustrate another preferred embodiment of the present invention, wherein the locking profile (15) is attached to the first toothed part (9) by clamping rather than by an adhesive. In this case, a groove or undercut (12) is provided in a surface (9*c*) of the first toothed part (9) defining the free end of the first toothed part (9) facing away the first side edge (2) of the corresponding panel (1), whereas the locking profile (15) comprises a shielding/clamping portion (20) extending from the first abutment portion (17) along an upper surface (9*b*) of the first toothed part (9) and further along the free end surface (9*c*) of the first toothed part (9) into the groove or undercut (12). In this preferred embodiment, the first toothed part (9) is shielded by the locking profile (15) from an accidental impact, thereby decreasing the probability that the first retaining profile (3) is damaged during transport or assembly or disassembly of the set of panels. Again, the shielding portion (20), and preferably also the first abutment portion (17), is immobilized in view of the first toothed part (9), whilst the remainder of the locking profile (15) is allowed to move in view of the first retaining profile (3) allowing interaction with the second toothed part (14) of a second panel (4) to locking two panels (1, 4).

Figure 5:
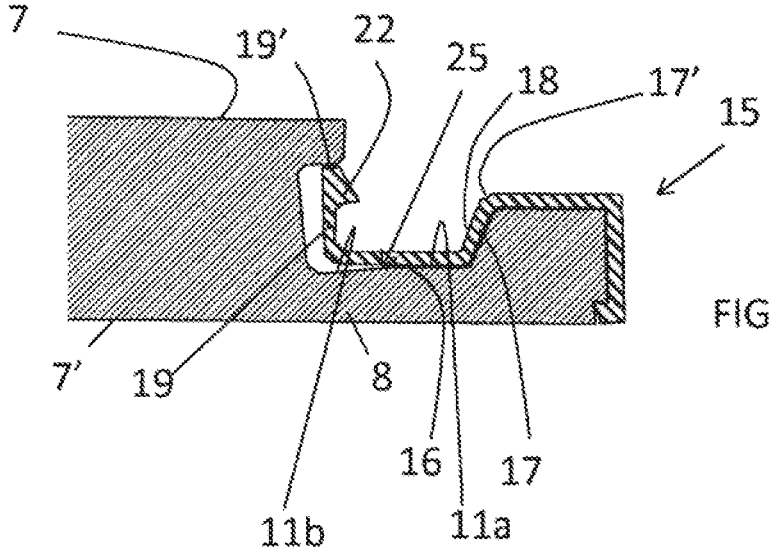
FIGS. 5&6 represent an alternative embodiment of FIG. 4 and a schematic representation of the assembly steps of a set of panels according to this embodiment.
Figure 6:
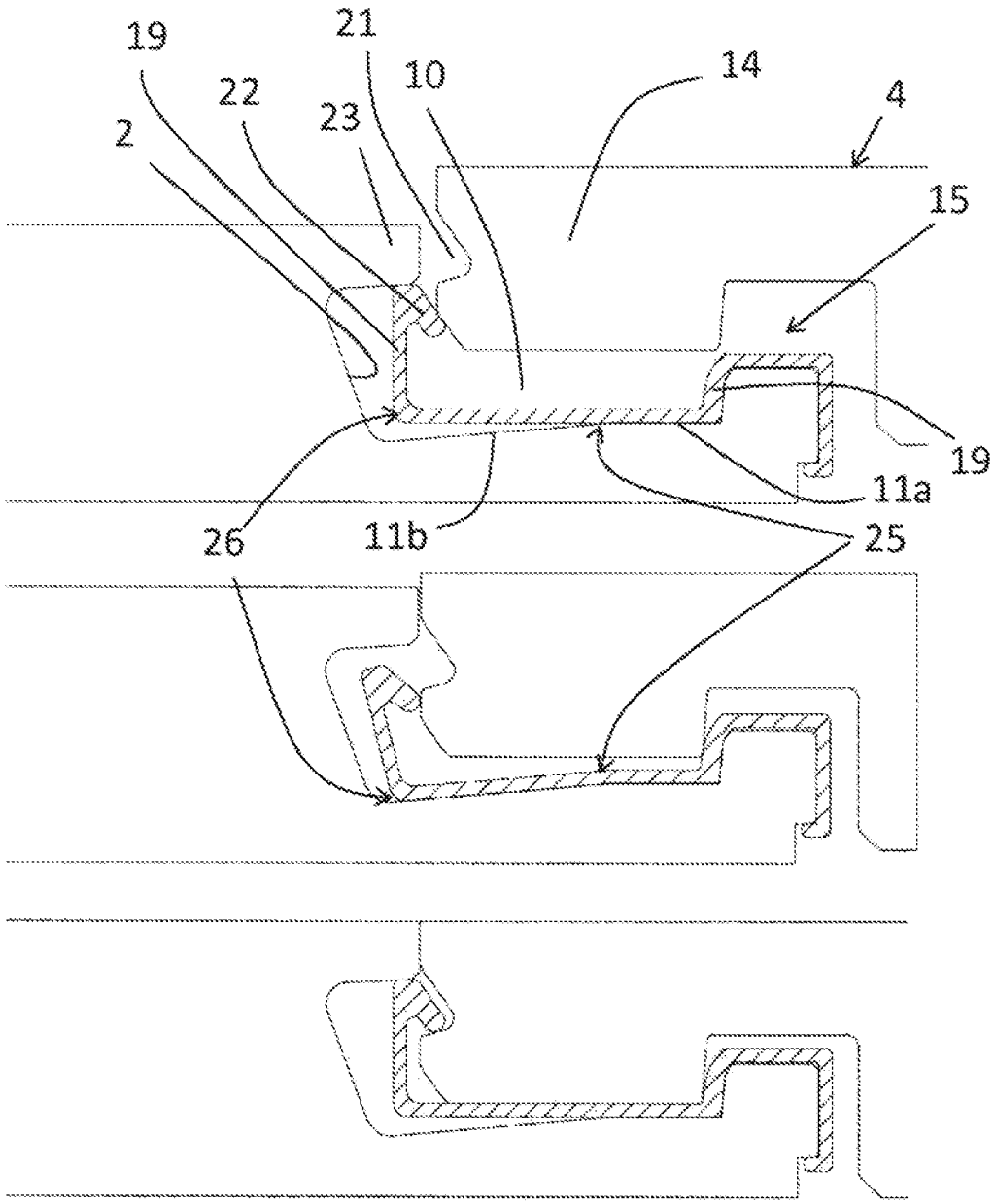

According to a third preferred embodiment that is illustrated in FIGS. 5&6, the first channel (10) and the locking profile (15) are configured such as to establish a pivot (25), further referred to as the first pivot, positioned along the base (16) of the locking profile. Such pivot allows broadening the aperture of the slot—i.e., the distance between the free ends (17', 19') of the first and second abutment portions (17, 19) of the locking profile—upon exerting a pressure on the second abutment portion (19) in a direction normal to the bottom surface (7') of the first panel (1) and in a direction from the decor surface (7) of the panels towards the bottom surface (7') of said panels.

In this case the pivot is obtained by making the surface (11) of the first protruding member (8) facing the base (16) of the locking profile (15) such that it comprises a support section (11*a*) extending such that upon joining two adjacent profiles, the locking profile (15) is clamped between the support section (11*a*) and the second toothed part (14); and a second section (11*b*) positioned such that a void remains present between that section (11*b*) of the surface (11) and the second locking profile (15) when in a non-tensed position. Further it is preferred that a free space is maintained between the first side edge (2) of the first panel (1) and the second abutment portion (19) of the locking profile (15) such that in case the second abutment portion (19) is pushed towards the bottom surface of the panel, the base (16) partially pivots downward and the free ends of the first and second abutment portions are spaced further apart and favoring a movement of the free end of the second abutment portion (19) towards the side edge (2) of the first panel (1) under protruding rim (23).

In a preferred embodiment and as shown in FIG. 6, the locking profile (15) comprises a pivot (26) (further referred to as second pivot although it can be provided in addition to or as alternative for the above described pivot (25), positioned at the transition of the base (16) and the second abutment portion (19) or along the second abutment portion (19), which pivot allows the second abutment portion (19) to partially tilt such that its free end is spaced further apart from the first abutment portion (17) upon exerting a pressure on the free end of the second abutment portion (19).

For sake of clarity, FIG. 6 schematically illustrates the functioning of the pivot, whereby during assembly the second toothed part (14) of the second panel (4) is inserted in the first channel (10), whereby the bottom surface of the second toothed part (14) contacts the rim (22) of the locking profile (15), pressing the rim (22) down- and sidewards. As a result of this pressure, the locking profile (15) pivots at first pivot (25) thereby tilting the second abutment portion (19) and rim (22) towards the side edge (2) of the first panel (in a direction under rim (23)) and as such increasing the distance between the free ends of the abutment portions 19) of the locking profile. This distance between the abutment portions (17, 19) is further increased by the tilting of the second abutment portion (19) in view of the base (16) of the locking profile at the second pivot (26). The increasing distance allows the second toothed part (14) to move further in the channel (10) until the bottom surface of the second toothed part (14) contacts the base of the locking profile (15) at least at the position corresponding to the support section (11*a*) of the base of the channel (10). In this position the downward pressure on the second abutment portion (19) of the locking profile is relieved and the locking profile pivots back towards its rest (unstressed) position, whereby the rim (22) of the locking profile now snaps into groove (21) in the second toothed part, thereby locking the first and second panels towards one another.

Figure 7:
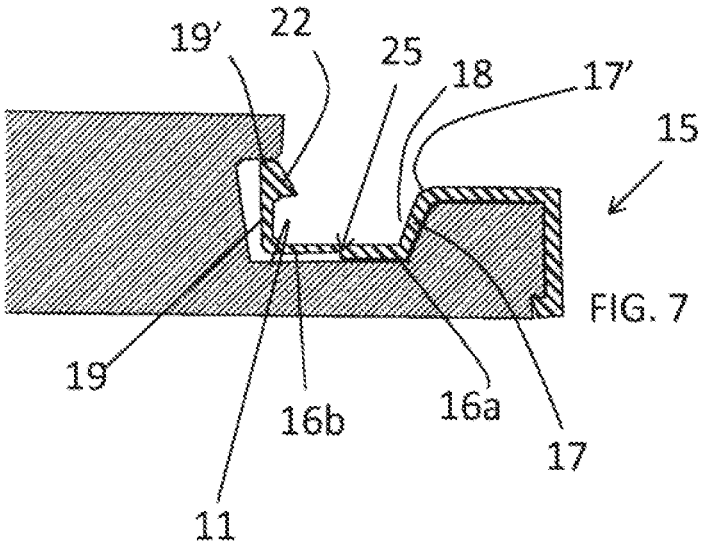
FIGS. 7&8 represent alternative embodiments of FIG. 4.

Alternatively as illustrated in FIG. 7, the pivot (25) is obtained by a variation in the thickness of the locking profile along its base (16), such that this base (16) comprises a relatively thick and rigid portion (16*a*) and a relatively thin and more flexible portion (16*b*). The functioning of this alternative is similar to the functioning of the alternative depicted in FIGS. 5 and 6.

Figure 8:
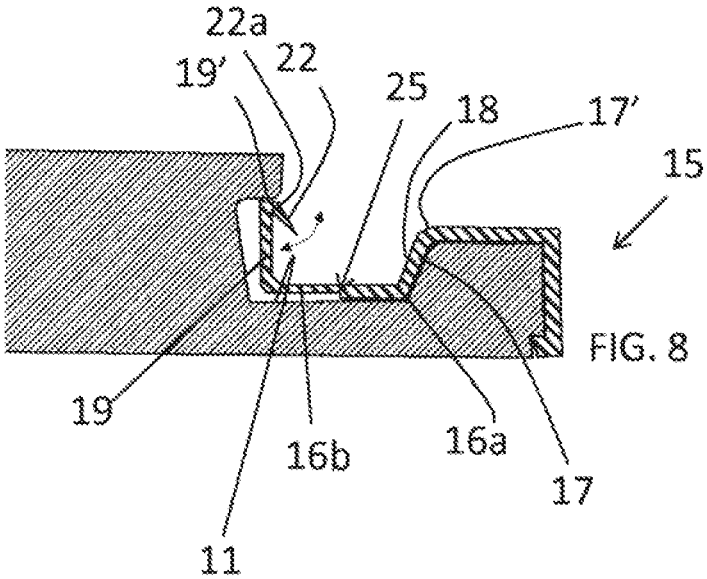

According to a fourth embodiment, as illustrated in FIG. 8, the rim (22) is compressible or made by bending over the free edge (19') of the second abutment portion (19) of the locking profile (15), whereby the bending point (22*a*) or section acts as a pivot between the rim (22) and the remainder of the second abutment portion (19).

In general, for all the above described embodiments, the locking profile (15), the first channel (10) and the second toothed part (14) of two adjacent panels are preferably configured such as to allow introduction of the second toothed part (14) in the channel (10) up to a point wherein both panels are locked, by a pure translation of both panels in view of one another, i.e., in case the panels form a flooring, a movement of the second panel (4) in view of the first panel (1), without tilting one or both panels. Such configuration is particularly feasible when the retaining profiles are provided at the short edges of the panels. In case the retaining profiles are provided at the long edges of the panels, the locking profile (15), the first channel (10) and the second toothed part (14) of two adjacent panels are preferably configured such as to allow the introduction of the second toothed part (14) in the slot up to a point wherein both panels are locked and to allow releasing one panel from another to which it is locked, by a combination of tilting (angling) and translation of both panels in view of one another.

For all the above described embodiments, the panels can be made from many different materials or combinations of materials as long as it is feasible to make the retaining profiles as described hereinbefore, on their edges.

The panels may be wood-based (e.g. a fiberboard (MDF, HDF), or a particle board). The panels may also be made of, or at least comprising a layer of, synthetic material. The term "synthetic material" as used in the context of the current invention, can be a single polymer or a blend of two or more polymers. The synthetic material can be, for example, a thermoplastic polymer, a thermosetting polymer, a rubber (elastomer), or any combinations thereof. In one particular example, the polymeric material is a thermoplastic polymer that includes vinyl containing thermoplastics such as polyvinyl chloride, polyvinyl acetate, polyvinyl alcohol, and other vinyl and vinylidene resins and copolymers thereof; polyethylenes such as low density polyethylenes and high density polyethylenes and copolymers thereof; styrenes such as ABS, SAN, and polystyrenes and copolymers thereof, polypropylene and copolymers thereof; saturated and unsaturated polyesters; acrylics; polyamides such as nylon containing types; engineering plastics such as polycarbonate, polyimide, polysulfone, and polyphenylene oxide and sulfide resins and the like. The synthetic material compound used to form the panel or a layer thereof can be a PVC powder compound that has good impact strength, ease of processing, high extrusion rate, good surface properties, excellent dimensional stability, and indentation resistance.

The panels may also comprise composite materials or one or more layers thereof, such as wood-plastic composites (WPC), referring to a composite structure comprising a wood-based material and a synthetic material. The panel may comprise multiple layers which can be identical or different with respect to composition and/or physical properties. In one embodiment, the panel may comprise a core, which can be single or multilayered, made from the materials described hereinbefore, and a top layer which may comprise a print layer and a wear layer. Alternatively, the panel may comprise a core, which can be single or multi-layered, made from the materials described hereinbefore, onto which a decor is digitally printed, the decor further being covered by a wear layer.

(1) first panel;
(2) side edge of first panel
(3) first retaining profile
(4) second panel
(5) side edge of second panel
(6) second retaining profile
(7) decor surface
(7') bottom surface
(8) first protruding member
(9) first toothed part
(9*a*) surface of first toothed part
(9*b*) upper surface of first toothed part
(9*c*) free end surface of first toothed
(10) first channel
(11) top surface of first protruding member
(11*a*) support section of top surface (11)
(11*b*) second section of top surface (11)
(12) undercut
(13) second protruding member
(14) second toothed part
(15) locking profile
(16) base of locking profile
(17) first abutment portion
(17') free end of first abutment portion
(18) surface of first abutment portion facing away the first toothed part (9)
(19) second abutment portion
(19') free end of second abutment portion
(20) shielding/clamping portion
(21) groove in second toothed panel
(22) rim of locking profile
(22*a*) bending point of second abutment portion
(23) protruding rim on first panel
(24) second channel
(25) first pivot
(26) second pivot
(27) lower surface of the second protruding member (13)
(28) lower surface of the second toothed part (14)

The invention claimed is:

1. A set of panels comprising:

a first panel (1) having a side edge (2) on which a first retaining profile (3) is disposed;

a second panel (4) having a side edge (5) on which a second retaining profile (6) is disposed that can be joined to the first retaining profile (3);

the first retaining profile (3) comprising a first protruding member (8) having a height HB-$H_{PM1}$ that is smaller than the height $H_B$, of the first panel (1); and a first toothed part (9) disposed at a free end of the first protruding member (8) and having a height $H_B$-$H_{T1}$ that is larger than $H_B$-$H_{PM1}$ and smaller than $H_B$ such as to define a first channel (10) between the first toothed part (9), a top surface (11) of the first protruding member (8) extending between the side edge (2) and first toothed part (9) and the side edge (2) of the first panel;

the first retaining profile (3) comprising a protruding rim (23) that extends from the side edge (2) along the length of that side edge (2) from a level $H_{TOP}$ to a level $H_R$ between $H_{TOP}$ and $H_{PM1}$, this protruding rim (23) as such partially extending above the first channel (10);

the second retaining profile (6) comprising a second protruding member (13) having a height $H_{PM2}$ that is smaller than the height $H_B$ of the second panel (4), and a second toothed part (14) disposed at a free end of the second protruding member (13), said second toothed part (14) configured to cooperate with the first channel (10), said second toothed part (14) comprising a groove (21) in a surface of the second toothed part (14) facing away from the side edge (5) of the second panel (4);

a locking profile (15) mounted to the first retaining profile (3), said locking profile (15) comprising:

a base (16) positioned in the first channel (10);

a first abutment portion (17) extending from a first edge of the base (16) and disposed along the edge of the first channel (10) defined by the toothed part (9), said first abutment portion (17) defining an abutment surface (18) facing the first channel (10);

a second abutment portion (19) extending from a second edge of the base (16) opposite the first edge and positioned in the first channel (10) along the side edge of the first panel (1), said second abutment portion (19) comprising a rim (22) at its free end and extending in a direction facing away from the side edge (2) of the first panel (1), such that the rim (22) of the locking profile is snapped into the groove (21) of the second retaining profile (6) upon joining two panels, said rim (22) of the second abutment portion (19) is compressible over the second abutment portion (19), in a direction substantially perpendicular to the side edge of the first panel, wherein the locking profile (15) is at least partially attached to the first toothed part (9).

2. The set of panels according to claim 1, wherein said rim (22) comprises a pivot allowing compressing the rim (22) in a direction substantially perpendicular to the side edge (2) of the first panel (1).

3. The set of panels according to claim 1, wherein said first channel (10) and the locking profile (15) mounted therein are configured such as to establish a first pivot (25) positioned along the base (16) of the locking profile (15).

4. The set of panels according to claim 3, wherein a surface (11) of the first protruding member (8) facing the base (16) of the locking profile (15) comprises a support section (11*a*) extending such that upon joining two adjacent profiles, the locking profile (15) is rigidly clamped between the support section (11*a*) and the second toothed part (14) and a second section (11*b*) positioned such that upon joining two adjacent profiles, a void remains present between the surface (11), the second toothed part (14) and the locking profile (15), thereby creating the first pivot (25).

5. The set of panels according to claim 1, wherein said first channel (10) and the locking profile (15) mounted therein are configured such as to establish a pivot (26) positioned at a transition of the base (16) and the second abutment portion (19) or along thy: second abutment portion (19).

6. The set of panels according to claim 1, wherein the dimensions of the first channel (10) and locking profile (15) are such that a free space remains between the second abutment portion (19) of the locking profile and the side edge (2) of the first panel (1) when said locking profile (15) is in a non-tensed position.

7. The set of panels according to claim 1, wherein the first toothed part (9) comprises a first groove or undercut (12) in its surface facing away the side edge (2) of the first panel (1); and in that said locking profile (15) comprises a clamping portion (20) extending into the groove or undercut (12) at the free end of the first toothed part.

8. The set of panels according to claim 1, wherein the locking profile (15) is attached to the first toothed part (9) with an adhesive.

9. The set of panels according claim 1, wherein the locking profile (15) is manufactured in one piece.

10. The set of panels according to claim 1, wherein the locking profile (15) is manufactured in a metallic material, preferably aluminum or spring steel or a polymeric material, preferably a fibre reinforced polymeric material.

11. The set of panels according to claim 1, wherein the first and second retaining profiles (3, 6) are provided on a short edge of said panels (1, 4).

12. The set of panels according claim 1, wherein the first and second retaining profiles (3, 6) are provided on a long edge of said panels (1, 4).

13. The set of panels according to claim 1, wherein the first channel (10), the locking profile (15) and the second toothed part (14) are configured such as to allow locking of the second panel to the first panel by a translation only of the second panel in view of the first panel.

14. Use of a locking profile (15) for locking two adjacent panels of a set of panels comprising:

joining a first panel (1) having a side edge (2) on which a first retaining profile (3) is disposed with a second panel (4) having a side edge (5) on which a second retaining profile (6) is disposed;

the first retaining profile (3) comprising a first protruding member (8) having a height $H_B$-$H_{PM1}$ that is smaller than the height $H_B$ of the first panel (1); and a first toothed part (9) disposed at a free end of the first protruding member (8) and having a height $H_B$-$H_{T1}$ that is larger than $H_B$-$H_{PM1}$ and smaller than such as to define a first channel (10) between the first toothed part (9), a top surface (11) of the first protruding member (8) extending between the side edge (2) and first toothed part (9) and the side edge (2) of the first panel;

the first retaining profile (3) comprising a protruding rim (23) that extends from the side edge (2) along the length of that side edge (2) from a level $H_{TOP}$ to a level $H_R$ between $H_{TOP}$ and $H_{PM1}$, this protruding rim (23) as such partially extending above the first channel (10);

the second retaining profile (6) comprising a second protruding member (13) having a height ($H_{PM2}$) that is smaller than the height ($H_B$) of the second panel (4)), and a second toothed part (14) disposed at a free end of the second protruding member (13), said second toothed part (14) configured to cooperate with the first channel (10), said second toothed part comprising a groove (21) in a surface of the second toothed part (14) facing away from the side edge (5) of the second panel; and mounting said locking profile (15) on the first retaining profile (3), said locking profile comprising:

a base (16) positioned in the first channel (10);

a first abutment portion (17) extending from a first edge of the base (16) and disposed along the edge of the first channel (10) defined by the toothed part (9), said first abutment portion (17) defining an abutment surface (18) facing the first channel (10);

a second abutment portion (19) extending from a second edge of the base (16) opposite the first edge and positioned in the first channel (10) along the side edge of the first panel, said second abutment portion (19) comprising a rim (22) at its free end and extending in a direction facing away from the side edge (2) of the first panel (1), said rim (22) of the second abutment portion (19) is compressible over the second abutment portion (19), in a direction substantially perpendicular to the side edge of the first panel and such that the rim (22) of the locking profile is snapped into the groove (21) of the second retaining profile (6) upon joining two panels;

establishing a first pivot position along the base of the locking profile with the configuration of said first channel and the locking profile mounted therein.

* * * * *